US005281128A

United States Patent [19]

Dalla Betta et al.

[11] Patent Number: 5,281,128

[45] Date of Patent: Jan. 25, 1994

[54] MULTISTAGE PROCESS FOR COMBUSTING FUEL MIXTURES

[75] Inventors: Ralph A. Dalla Betta, Mountain View, Calif.; Kazunori Tsurumi, Fujisawa; Nobuyasu Ezawa, Koto, both of Japan

[73] Assignees: Catalytica, Inc., Mountain View, Calif.; Tanaka Kikinzoku Kogyo K.K., Japan

[21] Appl. No.: 617,977

[22] Filed: Nov. 26, 1990

[51] Int. Cl.[5] ..... B01J 23/42; B01J 23/44; F23D 21/00

[52] U.S. Cl. ..... 431/7; 502/527; 502/262; 502/339

[58] Field of Search ..... 431/7, 170, 328; 60/723; 502/527, 262, 233, 339; 422/170, 171; 48/127.7

[56] References Cited

U.S. PATENT DOCUMENTS

| | | | |
|---|---|---|---|
| 3,870,455 | 3/1975 | Hindin | 431/7 |
| 3,969,082 | 7/1976 | Cairns et al. | 23/288 |
| 3,970,435 | 7/1976 | Schultz et al. | 48/61 |
| 4,019,969 | 4/1977 | Golebiowski et al. | 204/26 |
| 4,088,435 | 5/1978 | Hinden et al. | 431/7 |
| 4,118,199 | 10/1978 | Volker et al. | 422/171 |
| 4,220,559 | 9/1980 | Polinski | 252/455 |
| 4,270,896 | 6/1981 | Polinski et al. | 422/171 X |
| 4,279,782 | 7/1981 | Chapman et al. | 252/465 |
| 4,331,631 | 5/1982 | Chapman et al. | 422/180 |
| 4,414,023 | 11/1983 | Aggen et al. | 75/124 |
| 4,650,782 | 3/1987 | Onai | 502/333 X |
| 4,711,872 | 12/1987 | Kato et al. | 502/328 |
| 4,731,989 | 3/1988 | Furuya et al. | 60/39.05 |
| 4,793,797 | 12/1988 | Kato et al. | 431/7 |
| 4,849,399 | 7/1989 | Joy, III et al. | 502/333 |
| 4,870,824 | 10/1989 | Young et al. | 431/328 X |
| 4,893,465 | 1/1990 | Farrauto et al. | 60/39.02 |

FOREIGN PATENT DOCUMENTS

| | | | |
|---|---|---|---|
| 0198948 | 10/1986 | European Pat. Off. . | |
| 198948 | 10/1986 | European Pat. Off. . | |
| 0266875 | 5/1988 | European Pat. Off. | 502/333 |
| 57-210207 | 12/1982 | Japan | 431/170 |
| 59-136140 | 8/1984 | Japan . | |
| 60-14938 | 1/1985 | Japan . | |
| 60-14939 | 1/1985 | Japan . | |
| 60-026211 | 2/1985 | Japan . | |
| 60-51543 | 3/1985 | Japan . | |
| 60-51544 | 3/1985 | Japan . | |
| 60-51545 | 3/1985 | Japan . | |
| 60-53724 | 3/1985 | Japan . | |
| 60-54736 | 3/1985 | Japan . | |
| 60-060411 | 4/1985 | Japan . | |
| 60-60424 | 4/1985 | Japan . | |
| 60-66022 | 4/1985 | Japan . | |
| 60-147243 | 8/1985 | Japan . | |
| 60-175925 | 9/1985 | Japan . | |
| 60-196511 | 10/1985 | Japan . | |
| 60-200021 | 10/1985 | Japan . | |
| 60-202235 | 10/1985 | Japan . | |
| 60-202745 | 10/1985 | Japan . | |
| 60-205115 | 10/1985 | Japan . | |
| 60-205116 | 10/1985 | Japan . | |
| 60-205129 | 10/1985 | Japan . | |
| 60-222145 | 11/1985 | Japan . | |

(List continued on next page.)

OTHER PUBLICATIONS

Pennline, Henry W., Richard R. Schehl, and William P. Haynes, *Operation of a Tube Wall Methanation Reactor,*

(List continued on next page.)

*Primary Examiner*—Carl D. Price
*Attorney, Agent, or Firm*—Morrison & Foerster

[57] ABSTRACT

This invention is a combustion process having a series of stages in which the fuel is stepwise combusted using specific catalysts and catalytic structures and, optionally, a final homogeneous combustion zone. The choice of catalysts and the use of specific structures, including those employing integral heat exchange, results in a catalyst support which is stable due to its comparatively low temperature and yet the product combustion gas is at a temperature suitable for use in a gas turbine, furnace, boiler, or the like, but has low $NO_x$ content.

38 Claims, 6 Drawing Sheets

FOREIGN PATENT DOCUMENTS 60-238148 11/1985 Japan .
61-033233 2/1986 Japan .
61-038627 2/1986 Japan .
61-147014 7/1986 Japan .
61-209044 9/1986 Japan .
61-216734 9/1986 Japan .
61-235609 10/1986 Japan .
61-237905 10/1986 Japan .
61-252408 11/1986 Japan .
61-252409 11/1986 Japan .
61-259013 11/1986 Japan .
62-1454 1/1987 Japan .
62-041511 2/1987 Japan .
62-45343 2/1987 Japan .
62-046116 2/1987 Japan .
62-049125 3/1987 Japan .
62-71535 4/1987 Japan .
62-079847 4/1987 Japan .
62-80419 4/1987 Japan .
62-80420 4/1987 Japan .
62-084215 4/1987 Japan .
62-112910 5/1987 Japan .
62-125210 6/1987 Japan .

OTHER PUBLICATIONS

Ind. Eng. Chem. Process Des. Dev.: vol. 18, No. 1, 1979.

L. Louis Hegedus, "Temperature Excursions in Catalytic Monoliths", *AIChE Journal,* Sep. 1975, vol. 21, No. 5, 849–853.

Kee et al., "The Chemkin Thermodynamic Data Base", *Sandia National Laboratory Report No. SAND87-8215, 1987.*

Kubaschewski et al., "Metallurgical Thermo-Chemistry", *International Series on Materials Science and Technology,* 5th Edition, vol. 24, 382.

Hayashi et al., "Performance Characteristics of Gas Turbine Combustion Catalyst Under High Pressure", *Gas Turbine Society of Japan,* 1990, 18–69, 55.

Fig. 1A
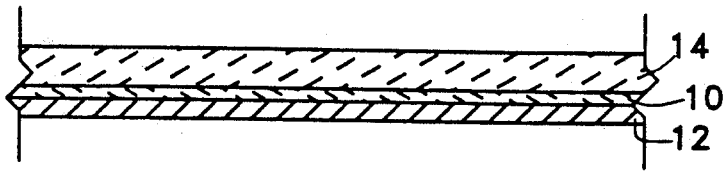
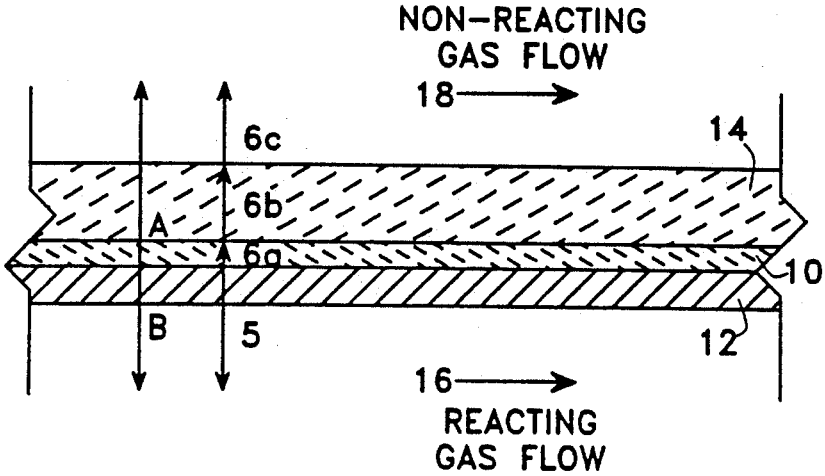
Fig. 1B
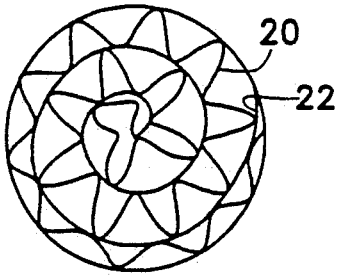
Fig. 2A
Fig. 2B
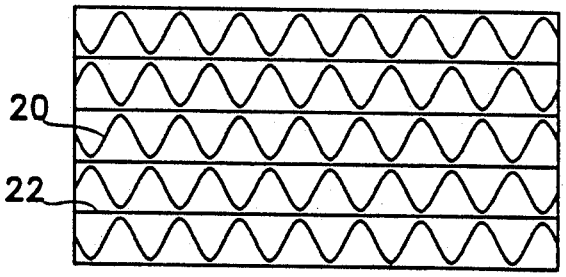
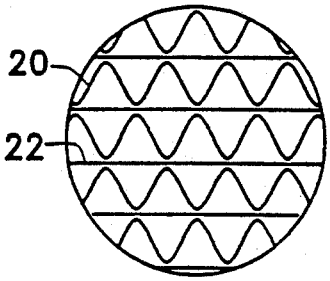
Fig. 2C

MULTISTAGE PROCESS FOR COMBUSTING FUEL MIXTURES

FIELD OF THE INVENTION

This invention is a combustion process having a series of stages in which the fuel is stepwise combusted using specific catalysts and catalytic structures and, optionally, a final homogeneous combustion zone. The choice of catalysts and the use of specific structures, including those employing integral heat exchange, results in a catalyst support which is stable due to its comparatively low temperature and yet the product combustion gas is at a temperature suitable for use in a gas turbine, furnace, boiler, or the like, but has low $NO_x$ content.

BACKGROUND OF THE INVENTION

With the advent of modern antipollution laws in the United States and around the world, significant and new methods of minimizing various pollutants are being investigated. The burning of fuel, be the fuel wood, coal, oils, or natural gas, likely causes a majority of the pollution problems in existence today. Certain pollutants such as $SO_2$, which are created as the result of the presence of a contaminant in the fuel source, may be removed either by treating the fuel to remove the contaminant or by treating the exhaust gas eventually produced to remove the resulting pollutant. Pollutants such as carbon monoxide, which are created as the result of incomplete combustion, may be removed by post-combustion oxidation or by improving the combustion process. The other principal pollutant, $NO_x$ (an equilibrium mixture mostly of NO, but also containing very minor amounts of $NO_2$), may be dealt with either by controlling the combustion process to minimize its production or by later removal. Removal of $NO_x$ once produced once it is a difficult task because of its relative stability and its low concentration in most exhaust gases. One ingenious solution used in automobiles is the use of carbon monoxide chemically to reduce $NO_x$ to nitrogen while oxidizing the carbon monoxide to carbon dioxide. However, the need to react two pollutants alsospeaks to a conclusion that the initial combustion reaction was inefficient.

It must be observed that unlike the situation with sulfur pollutants where the sulfur contaminant may be removed from the fuel, removal of nitrogen from the air fed to the combustion process is clearly an impractical solution. Unlike the situation with carbon monoxide, improvement of the combustion reaction would likely increase the level of $NO_x$ produced due to the higher temperatures then involved.

Nevertheless, the challenge to reduce combustion $NO_x$ remains and several different methods have been suggested. The process chosen must not substantially conflict with the goal for which the combustion gas was created, i.e., the recovery of its heat value in a turbine, boiler, or furnace.

Many recognize that a fruitful way of controlling $NO_x$ production is to limit the localized and bulk temperatures in the combustion zone to something less than 1800° C. See, for instance, U.S. Pat. No. 4,731,989 to Furuya et al. at column 1, lines 52–59 and U.S. Pat. No. 4,088,435 to Hindin et al. at column 12.

There are a number of ways to control the temperature, such as by dilution with excess air, controlled oxidation using one or more catalysts, or staged combustion using variously lean or rich fuel mixtures. Combinations of these methods are also known.

One widely attempted method is the use of multistage catalytic combustors. Most of these processes utilize multi-section catalysts with metal oxide or ceramic catalyst carriers. Typical of such disclosures are:

| Country | Document | 1st Stage | 2nd Stage | 3rd Stage |
|---|---|---|---|---|
| Japan | Kokai 60-205129 | Pt-group/$Al_2O_3$ & $SiO_2$ | La/$SiO_2$.$Al_2O_3$ | |
| Japan | Kokai 60-147243 | La & Pd & Pt/$Al_2O_3$ | ferrite/$Al_2O_3$ | |
| Japan | Kokai 60-66022 | Pd & Pt/$ZrO_2$ | Ni/$ZrO_2$ | |
| Japan | Kokai 60-60424 | Pd/– | CaO & $Al_2O_3$ & NiO & w/noble metal | |
| Japan | Kokai 60-51545 | Pd/* | Pt/* | $LaCoO_3$/* |
| Japan | Kokai 60-51543 | Pd/* | Pt/* | |
| Japan | Kokai 60-51544 | Pd/* | Pt/* | base metal oxide/* |
| Japan | Kokai 60-54736 | Pd/* | Pt or Pt—Rh or Ni base metal oxide or $LaCO_3$/* | |
| Japan | Kokai 60-202235 | $MoO_4$/– | $CoO_3$ & $ZrO_2$ & noble metal | |
| Japan | Kokai 60-200021 | Pd & $Al_2O_3$/+* | Pd & $Al_2O_3$/** | Pt/** |
| Japan | Kokai 60-147243 | noble metal/heat resistant carrier | ferrite/heat resistant carrier | |
| Japan | Kokai 60-60424 | La or Nd/$Al_2O_3$ 0.5% $SiO_2$ | Pd or Pt/NiO & $Al_2O_3$ & CaO 0.5% SiO | |
| Japan | Kokai 60-14938 | Pd/? | Pt/? | |
| Japan | Kokai 60-14939 | Pd & Pt/refractory | ? | ? |
| Japan | Kokai 60-252409 | Pd & Pt/*** | Pd & Ni/*** | Pd & Pt/*** |
| Japan | Kokai 60-080419 | Pd & Pt | Pd, Pt & NiO | Pt or Pt & Pd |
| Japan | Kokai 60-080420 | Pd & Pt & NiO | Pt | Pt & Pd |
| Japan | Kokai 60-080848 | Pt & Pd | Pd & Pt & NiO | Pt or Pt & Pd |
| Japan | Kokai 60-080849 | Pd, Pt, NiO/? | Pd & Pt (or NiO)/? | Pt or Pd & Pt/? |

*alumina or zirconia on mullite or cordierite
**Ce in first layer; one or more of Zr, Sr, Ba in second layer; at least one of La and Nd in third layer.
***monolithic support stabilized with lanthanide or alkaline earth metal oxide
Note: the catalysts in this Table are characterized as "a"/"b" where "a" is the active metal and "b" is the carrier The use of such ceramic or metal oxide supports is clearly well-known. The structures formed do not readily melt or oxidize as would a metallic support. A ceramic support carefully designed for use in a particular temperature range can provide adequate service in that temperature range. Nevertheless, many such materials can undergo phase changes or react with other components of the catalyst system at temperatures above 1100° C., e.g., the gamma alumina phase changes to the alpha alumina form in that region. In addition, such ceramic substrates are olefin fragile, subject to cracking and failure as a result of vibration, mechanical shock, or thermal shock. Thermal shock is a particular problem in catalytic combustors used in gas turbines. During startup and shutdown, large temperature gradients can develop in the catalyst leading to high mechanical stresses that result in cracking and fracture.

Typical of the efforts to improve the high temperature stability of the metal oxide or ceramic catalyst supports are the inclusion of an alkaline earth metal or lanthanide or additional metals into the support, often in combination with other physical treatment steps:

| Country | Document | Assignee or Inventor |
|---|---|---|
| Japan | Kokai 61-209044 | (Babcock-Hitachi KK) |
| Japan | Kokai 61-216734 | (Babcock-Hitachi KK) |
| Japan | Kokai 62-071535 | (Babcock-Hitachi KK) |
| Japan | Kokai 62-001454 | (Babcock-Hitachi KK) |
| Japan | Kokai 62-045343 | (Babcock-Hitachi KK) |
| Japan | Kokai 62-289237 | (Babcock-Hitachi KK) |
| Japan | Kokai 62-221445 | (Babcock-Hitachi KK) |
| U.S. | U.S. Pat. No. 4,793,797 | (Kato et al.) |
| U.S. | U.S. Pat. No. 4,220,559 | (Pliknki et al.) |
| U.S. | U.S. Pat. No. 3,870,455 | (Hindin et al.) |
| U.S. | U.S. Pat. No. 4,711,872 | (Kato et al.) |
| Great Britain | 1,528,455 | Cairns et al. |

However, even with the inclusion of such high temperature stability improvements, ceramics are fragile materials. Japanese Kokai 60-053724 teaches the use of a ceramic columnar catalyst with holes in the column walls to promote equal distribution of fuel gas and temperature amongst the columns lest cracks appear.

High temperatures (above 1100° C.) are also detrimental to the catalytic layer resulting in surface area loss, vaporization of metal catalysts, and reaction of catalytic components with the ceramic catalyst components to form less active or inactive substances.

Of the numerous catalysts disclosed in the combustion literature may be found the platinum group metals: platinum, palladium, ruthenium, iridium, and rhodium; sometimes alone, sometimes in mixtures with other members of the group, sometimes with non-platinum group promoters or co-catalysts.

In addition to the strictly catalytic combustion processes, certain processes use a final step in which remaining combustibles are homogeneously oxidized prior to recovering the heat from the gas.

A number of the three stage catalyst combination systems discussed above also have post-combustion steps. For instance, a series of Japanese Kokai assigned to Nippon Shokubai Kagaku ("NSK") (62-080419, 62-080420, 63-080847, 63-080848, and 63-080549) disclose three stages of catalytic combustion followed by a secondary combustion step. As was noted above, the catalysts used in these processes are quite different from the catalysts used in the inventive process. Additionally, these Kokai suggest that in the use of a post-combustion step, the resulting gas temperature is said to reach only "750° C. to 1100° C.". In clear contrast, the inventive process when using the post catalyst homogeneous combustion step may be seen to reach substantially higher adiabatic combustion temperatures.

Other combustion catalyst/post-catalyst homogeneous combustion processes are known. European Patent Application 0,198,948 (also issued to NSK) shows a two or three stage catalytic process followed by a post-combustion step. The temperature of the post-combusted gas was said to reach 1300° C. with an outlet temperature from the catalyst (approximately the bulk gas phase temperature) of 900° C. The catalyst structures disclosed in the NSK Kokai are not, however, protected from the deleterious effects of the combustion taking place within the catalytic zones and consequently the supports will deteriorate.

The patent to Furuya et al. (U.S. Pat. No. 4,731,989) discloses a single stage catalyst with injection of additional fuel followed by post-catalyst combustion. In this case, the low fuel/air ratio mixture feed to the catalyst limits the catalyst substrate temperature to 900° C. or 1000° C. To obtain higher gas temperatures required for certain processes such as gas turbines, additional fuel is injected after the catalyst and this fuel is burned homogeneously in the post catalyst region. This process is complicated and requires additional fuel injection devices in the hot gas stream exiting the catalyst. The inventive device described in our invention does not require fuel injection after the catalyst; all of the fuel is added at the catalyst inlet.

An aspect in the practice of our inventive process is the use of integral heat exchange structures—preferably metal and in at least in the latter catalytic stage or stages of the oxidation. Generically, the concept is to position a catalyst layer on one surface of a wall in the catalytic structure which is opposite a surface having no catalyst. Both sides are in contact with the flowing fuel-gas mixture. On one side reactive heat is produced; on the other side that reactive heat is transferred to the flowing gas.

Structures having an integral heat exchange feature are shown in Japanese Kokai 59-136,140 and 61-259,013. Similarly, U.S. Pat. No. 4,870,824 to Young et al. shows a single stage catalytic combustor unit using a monolithic catalyst with catalysts on selected passage walls. In addition to a number of other differences, the structures are disclosed to be used in isolation and not in conjunction with other catalyst stages. Additionally, the staged use of the structure with different catalytic metals is not shown in the publications.

None of the processes shown in this discussion show a combination catalyst system in which the catalyst supports are metallic, in which the catalysts are specifically varied to utilize their particular benefits, in which integral heat exchange is selectively applied to control catalyst substrate temperature, and particularly, in which high gas temperatures are achieved while maintaining low $NO_x$ production and low catalyst (and support) temperatures.

SUMMARY OF THE INVENTION

This invention is a combustion process in which the fuel is premixed at a specific fuel/air ratio to produce a combustible mixture having a desired adiabatic combustion temperature. The combustible mixture is then reacted in a series of catalyst structures and optionally in a homogeneous combustion zone. The combustion is staged so that catalyst and bulk gas temperatures are controlled at a relatively low value through catalyst choice and structure. The process produces an exhaust gas of a very low $NO_x$ concentration but at a temperature suitable for use in a gas turbine, boiler, or furnace.

BRIEF DESCRIPTION OF THE DRAWINGS

FIGS. 1A and 1B show close-up, cutaway views of a catalyst structure wall having catalyst only on one side.

FIGS. 2A, 2B, 2C, 3A, 3B, 4, 5A, and 5B all show variations of the integral heat exchange catalyst structure which may be used in the later stage of the inventive process.

DESCRIPTION OF THE INVENTION

Figure 3A:
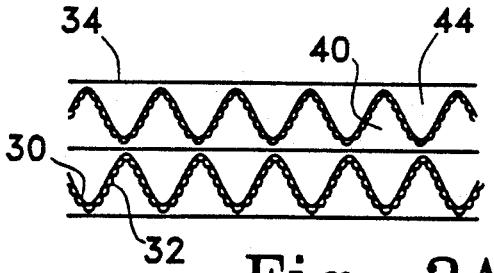

This invention is a combustion process in which the fuel is premixed at a specific fuel/air ratio to produce a combustible mixture having a desired adiabatic combustion temperature. The combustible mixture is then reacted in a series of catalyst structures and optionally in a homogeneous combustion zone. The combustion is staged so that catalyst and bulk gas temperatures are controlled at a relatively low value through catalyst choice and structure. The process produces an exhaust gas of a very low $NO_x$ concentration but at a temperature suitable for use in a gas turbine, boiler, or furnace.

This process may be used with a variety of fuels and at a broad range of process conditions.

Although normally gaseous hydrocarbons, e.g., methane, ethane, and propane, are highly desireable as a source of fuel for the process, most fuels capable of being vaporized at the process temperatures discussed below are suitable. For instance, the fuels may be liquid or gaseous at room temperature and pressure. Examples include the low molecular weight hydrocarbons mentioned above as well as butane, pentane, hexane, heptane, octane, gasoline, aromatic hydrocarbons such as benzene, toluene, ethylbenzene; and xylene; naphthas; diesel fuel, kerosene; jet fuels; other middle distillates; heavy distillate fuels (preferably hydrotreated to remove nitrogenous and sulfurous compounds); oxygen-containing fuels such as alcohols including methanol, ethanol, isopropanol, butanol, or the like; ethers such as diethylether, ethyl phenyl ether, MTBE, etc. Low-BTU gases such as town gas or syngas may also be used as fuels.

The fuel is typically mixed into the combustion air in an amount to produce a mixture having a theoretical adiabatic combustion temperature greater than the catalyst or gas phase temperatures actually occurring in the catalysts employed in this inventive process. Preferably the adiabatic combustion temperature is above 900° C., and most preferably above 1000° C. Non-gaseous fuels should be vaporized prior to their contacting the initial catalyst zone. The combustion air may be at atmospheric pressure or lower (−0.25 atm of air) or may be compressed to a pressure of 35 atm or more of air. Stationary gas turbines (which ultimately could use the gas produced by this process) often operate at gauge pressures in the range of eight atm of air to 35 atm of air. Consequently, this process may operate at a pressure between −0.25 atm of air and 35 atm of air, preferably between zero atm of air and 17 atm of air.

First Catalytic Zone

The fuel/air mixture supplied to the first zone should be well mixed and heated to a temperature high enough to initiate reaction on the first zone catalyst; for a methane fuel on a typical palladium catalyst a temperature of at least about 325° C. is usually adequate. This preheating may be achieved by partial combustion, use of a pilot burner, by heat exchange, or by compression.

The first zone in the process contains a catalytic amount of palladium on a monolithic catalyst support offering low resistance to gas flow. The support is preferably metallic. Palladium is very active at 325° C. and lower for methane oxidation and can "light off" or ignite fuels at low temperatures. It has also been observed that in certain instances, after palladium initiates the combustion reaction, the catalyst rises rapidly to temperatures of 750° C. to 800° C. at one atm of air or about 940° C. at ten atm total pressure of air. These temperatures are the respective temperatures of the transition points in the thermal gravimetric analysis (TGA) of the palladium/palladium oxide reaction shown below at the various noted pressures. At that point the catalytic reaction slows substantially and the catalyst temperature moderates at 750° C. to 800° C. or 940° C., depending on pressure. This phenomenon is observed even when the fuel/air ratio could produce theoretical adiabatic combustion temperatures above 900° C. or as high as 1700° C.

One explanation for this temperature limiting phenomenon is the conversion of palladium oxide to palladium metal at the TGA transition point discussed above. At temperatures below 750° C. at one atm of air, palladium is present mainly as palladium oxide. Palladium oxide appears to be the active catalyst for oxidation of fuels. Above 750° C., palladium oxide converts to palladium metal according to this equilibrium:

$$PdO \rightarrow Pd + \tfrac{1}{2}O_2$$

Palladium metal appears to be substantially less active for hydrocarbon oxidation so that at temperatures above 750° C. to 800° C. the catalytic activity decreases appreciably. This transition causes the reaction to be self-limiting: the combustion process rapidly raises the catalyst temperature to 750° C. to 800° C. where temperature self-regulation begins. This limiting temperature is dependent on $O_2$ pressure and will increase as the $O_2$ partial pressure increases.

Some care is necessary, however. The high activity of palladium can lead to "runaway" combustion where even the low activity of the palladium metal above 750° C. can be sufficient to cause the catalyst temperature to rise above 800° C. and even to reach the adiabatic combustion temperature of the fuel/air mixture as noted above; temperatures above 1100° C. can lead to severe deterioration of the catalyst. We have found that runaway combustion can be controlled by adding a diffusion barrier layer on top of the catalyst layer to limit the supply of fuel and/or oxidant to the catalyst. The diffusion layer greatly extends the operating range of the first stage catalyst to higher preheat temperatures, lower linear gas velocities, higher fuel/air ratio ranges, and higher outlet gas temperatures. We have also found that limiting the concentration of the palladium metal on the substrate will prevent "runaway" but at the cost of relatively shorter catalyst life.

This self-limiting phenomenon maintains the catalyst substrate temperature substantially below the adiabatic combustion temperature. This prevents or substantially decreases catalyst degradation due to high temperature operation.

The palladium metal is added in an amount sufficient to provide significant activity. The specific amount added depends on a number of requirements., e.g., economics, activity, life, contaminant presence, etc. The theoretical maximum amount is likely enough to cover the maximum amount of support without causing undue metal crystallite growth and concomitant loss of activity. These clearly are competing factors: maximum catalytic activity requires higher surface coverage, but higher surface coverage can promote growth between adjacent crystallites. Furthermore, the form of the catalyst support must be considered. If the support is used in a high space velocity environment, the catalyst loadings likely should be high to maintain sufficient conversion even though the residence time is low. Economics has as its general goal the use of the smallest amount of catalytic metal which will do the required task. Finally, the presence of contaminants in the fuel would mandate the use of higher catalyst loadings to offset the deterioration of the catalyst by deactivation.

The palladium metal content of this catalyst composite is typically quite small, e.g., from 0.1% to about 15% by weight, and preferably from 0.01% to about 25% by weight.

In addition to palladium, the catalysts may optionally contain up to an equivalent amount of one or more catalyst adjuncts, Group IB or Group VIII noble metals. The preferred adjunct catalysts are silver, gold, ruthenium, rhodium, platinum, iridium, or osmium. Most preferred are silver and platinum.

The palladium may be incorporated onto the support in a variety of different methods using palladium complexes, compounds, or dispersions of the metal. The compounds or complexes may be water or hydrocarbon soluble. They may be precipitated from solution. The liquid carrier generally needs only to be removable from the catalyst carrier by volatilization or decomposition while leaving the palladium in a dispersed form on the support. Examples of the palladium complexes and compounds suitable in producing the catalysts used in this invention are palladium chloride, palladium diammine dinitrite, palladium tetrammine chloride, palladium 2-ethylhexanoic acid, sodium palladium chloride, and other palladium salts or complexes.

The preferred supports for this catalytic zone are metallic. Although other support materials such as ceramics and the various inorganic oxides typically used as supports: silica, alumina, silica-alumina, titania, zirconia, etc., and may be used with or without additions such as barium, cerium, lanthanum, or chromium added for stability. Metallic supports in the form of honeycombs, spiral rolls of corrugated sheet (which may be interspersed with flat separator sheets), columnar (or "handful of straws"), or other configurations having longitudinal channels or passageways permitting high space velocities with a minimal pressure drop are desireable in this service. They are malleable, can be mounted and attached to surrounding structures more readily, and offer lower flow resistance due to the thinner walls that can be readily manufactured in ceramic supports. Another practical benefit attributable to metallic supports is the ability to survive thermal shock. Such thermal shocks occur in gas turbine operations when the turbine is started and stopped and, in particular, when the turbine must be rapidly shut down. In this latter case, the fuel is cut off or the turbine is "tripped" because the physical load on the turbine—e.g., a generator set—has been removed. Fuel to the turbine is immediately cut off to prevent overspeeding. The temperature in the combustion chambers, where the inventive process takes place, quickly drops from the temperature of combustion to the temperature of the compressed air. This drop could span more than 1000° C. in less than one second. In any event, the catalyst is deposited, or otherwise placed, on the walls within the channels or passageways of the metal support in the amounts specified above. The catalyst may be introduced onto the support in a variety of formats: the complete support may be covered, the downstream portion of the support may be covered, or one side of the support's wall may be covered to create an integral heat exchange relationship such as that discussed with regard to the later stages below. The preferred configuration is complete coverage because of the desire for high overall activity at low temperatures but each of the others may be of special use under specific circumstances. Several types of support materials are satisfactory in this service: aluminum, aluminum containing or aluminum-treated steels, and certain stainless steels or any high temperature metal alloy, including nickel alloys where a catalyst layer can be deposited on the metal surface.

The preferred materials are aluminum-containing steels such as those found in U.S. Pat. Nos. 4,414,023 to Aggen et al., 4,331,631 to Chapman et al., and 3,969,082 to Cairns, et al. These steels, as well as others sold by Kawasaki Steel Corporation (River Lite 20-5 SR), Vereinigte Deutchse Metallwerke AG (Alumchrom I RE), and Allegheny Ludlum Steel (Alfa-IV) contain sufficient dissolved aluminum so that, when oxidized, the aluminum forms alumina whiskers or crystals on the steel's surface to provide a rough and chemically reactive surface for better adherence of the washcoat.

The washcoat may be applied using an approach such as is described in the art, e.g., the application of zirconia or gamma-alumina sols or sols of mixed oxides containing aluminum, silicon, titanium, zirconium, and additives such as barium, cerium, lanthanum, chromium, or a variety of other components. For better adhesion of the washcoat, a primer layer may be applied containing hydrous oxides such as a dilute suspension of pseudoboehmite alumina as described in U.S. Pat. No. 4,729,782 to Chapman et al. Desirably, however, the primed surface is then coated with a zirconia suspension, dried, and calcined to form a high surface area adherent oxide layer on the metal surface.

The washcoat may be applied in the same fashion one would apply paint to a surface, e.g., by spraying, direct application, dipping the support into the washcoat material, etc.

Aluminum structures are also suitable for use in this invention and may be treated or coated in essentially the same manner. Aluminum alloys are somewhat more ductile and likely to deform or even to melt in the temperature operating envelope of the process. Consequently, they are less desireable supports but may be used if the temperature criteria can be met.

Once the washcoat and palladium have been applied to the metallic support and calcined, one or more coatings of a low or non-catalytic oxide may then be applied as a diffusion barrier to prevent the temperature "runaway" discussed above. This barrier layer may be alumina, silica, zirconia, titania, or a variety of other oxides with a low catalytic activity for oxidation of the fuel or mixed oxides or oxides plus additives similar to those described for the washcoat layer. Alumina is the least desireable of the noted materials. The barrier layer can range in thickness from 1% of the washcoat layer thickness to a thickness substantially thicker than the washcoat layer, but preferably from 10% to 100% of the washcoat layer thickness. The preferred thickness will depend on the operating conditions of the catalyst, including the fuel type, the gas flow velocity, the preheat temperature, and the catalytic activity of the washcoat layer. It has also been found that the application of the diffusion barrier coating only to a downstream portion of the catalyst structure, e.g., 30% to 70% of the length, can provide sufficient protection for the catalyst under certain conditions.

As with the washcoat, the barrier layer or layers may be applied using the same application techniques one would use in the application of paint.

This catalyst structure should be made in such a size and configuration that the average linear velocity through the channels in the catalyst structure is greater than about 0.2 m/second and no more than about 40 m/second throughout the first catalytic zone structure. This lower limit is an amount larger than the flame front speed for methane and the upper limit is a practical one for the type of supports currently commercially available. These average velocities may be somewhat different for fuels other than methane.

The first catalytic zone is sized so that the bulk outlet temperature of the gas from that zone is no more than about 800° C., preferably in the range of 450° C. to 700° C. and, most preferably, 500° C. to 650° C.

Second Catalytic Zone

The second zone in the process takes partially combusted gas from the first zone and causes further controlled combustion to take place in the presence of a catalyst structure having heat exchange capabilities and desirably utilizing at least palladium as the catalytic material. The catalyst contains palladium and, optionally, may contain up to an equivalent amount of one or more adjuncts Group IB or Group VIII noble metals. The preferred adjunct catalysts are silver, gold, ruthenium, rhodium, platinum, iridium, or osmium. Most preferred are silver and platinum. This zone may operate adiabatically with the heat generated in the oxidation of the fuel resulting in a rise in the gas temperature. Neither air nor fuel is added between the first and second catalytic zone.

The catalyst structure in this zone is similar to that used in the first catalytic zone except that the catalyst preferably is applied to at least a portion of only one side of the surface forming the walls of the monolithic catalyst support structure. FIG. 1A shows a cutaway of a the high surface area metal oxide washcoat (10), and active metal catalyst (12) applied to one side of the metal substrate (14). This structure readily conducts the reaction heat generated at the catalyst through interface between the washcoat layer (10) and gas flow (16) in FIG. 1B. Due to the relatively thermal high conductivity of the washcoat (10) and metal (14), the heat is conducted equally along pathway (A) as well as (B), dissipating the reaction heat equally into flowing gas streams (16) and (18). This integral heat exchange structure will have a substrate or wall temperature given by equation (1):

$$T_{wall} = \frac{T_{gas\ inlet} + T_{adiabatic}}{2} \quad (1)$$

The wall temperature rise will be equal to about half the difference between the inlet temperature and the theoretical adiabatic combustion temperature.

Metal sheets coated on one side with catalyst, and the other surface being non-catalytic, can be formed into rolled or layered structures combining corrugated (20) and flat sheets (22) as shown in FIGS. 2A through 2C to form long open channel structures offering low resistance to gas flow. A corrugated metal strip (30) coated on one side with catalyst (32) can be combined with a separator strip (34) not having a catalytic coating to form the structure shown in FIG. 3A.

Figure 3B:
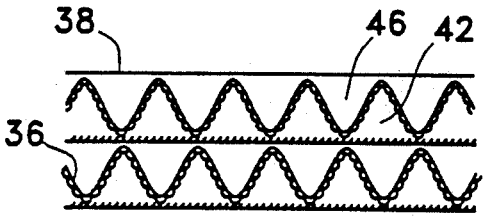

Alternatively, corrugated (36) and flat strips (38) both coated with catalyst on one side prior to assembly into a catalyst structure can be combined as shown in FIG. 3B. The structures form channels with catalytic walls (40 in FIG. 3A and 42 in FIG. 3B) and channels with non-catalytic walls (44 in FIG. 3A and 46 in FIG. 3B). Catalytic structures arranged in this manner with catalytic channels and separate non-catalytic channels (limited-integral heat-exchange structures "L-IHE"), are described in co-pending application (Attorney's Docket PA-0010). These structure have the unique ability to limit the catalyst substrate temperature and outlet gas temperature.

Figure 4:
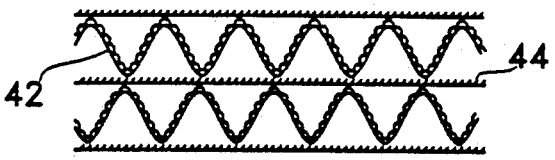

The corrugated (42) and flat sheets (44) coated on one side with catalyst can be arranged according to FIG. 4 where the catalytic surface of each sheet faces a different channel so that all channels have a portion of their walls' catalyst coated and all walls have one surface coated with catalyst and the opposite surface non-catalytic. The FIG. 4 structure will behave differently from the FIG. 3A and FIG. 3B structures. The walls of the FIG. 4 structure form an integral heat exchange but, since all channels contain catalyst, there is then a potential for all the fuel to be catalytically combusted. As combustion occurs at the catalyst surface, the temperature of the catalyst and support will rise and the heat will be conducted and dissipated in the gas flow on both the catalytic side and the non-catalytic side. This will help to limit the temperature of the catalyst substrate and will aid the palladium temperature limiting to maintain the wall temperature at 750° C. to 800° C. (at one atm of air) or about 930° C. (at ten atm of air). For sufficiently long catalysts or low gas velocities, a constant outlet gas temperature of 750° C. to 800° C. would be obtained for any fuel/air ratio with an adiabatic combustion temperature above approximately 800° C. at one atm of air or about 930° C. at ten atm of air.

The structures shown in FIGS. 3A and 3B have equal gas flow through each of the catalytic channels and non-catalytic channels. The maximum gas temperature rise with these structures will be that produced by 50% combustion of the inlet fuel.

Figure 5A:
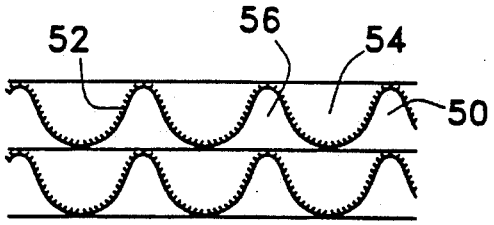
Figure 5B:
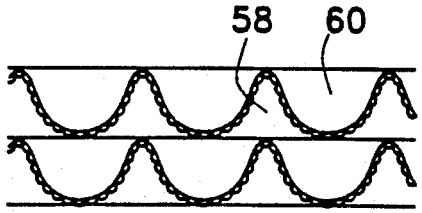

The structures shown in FIGS. 3A and 3B may be modified to control the fraction of fuel and oxygen reacted by varying the fraction of the fuel and oxygen mixture that passes through catalytic and non-catalytic channels. FIG. 5A shows a structure where the corrugated foil has a structure with alternating narrow (50) and broad (52) corrugations. Coating this corrugated foil on one side results in a large catalytic channel (54) and a small non-catalytic channel (56). In this structure approximately 80% of the gas flow would pass through catalytic channels and 20% through the non-catalytic channels. The maximum outlet gas temperature would be about 80% of the temperature rise expected if the gas went to its adiabatic combustion temperature. Conversely, coating the other side of the foil only (FIG. 5B) results in a structure with only 20% of the gas flow through catalytic channels (58) and a maximum outlet gas temperature increase of 20% of the adiabatic combustion temperature rise. Proper design of the corrugation shape and size can achieve any level of conversion from 5% to 95% while incorporating integral heat exchange. The maximum outlet gas temperature can be calculated by equation 2 below:

$$T_{gas\ max} = T_{gas\ inlet} + [T_{adiabatic} - T_{gas\ inlet}] \times \frac{\text{catalytic gas flow}}{\text{non-catalytic gas flow}} \quad (2)$$

To illustrate the operation of this integral heat exchange zone, assume that a partially oxidized gas from the first catalytic zone flows into the FIG. 3A structure in which the gas flow through the catalytic channels is 50% of the total flow.

Approximately half of the gas flow will pass through channels with catalytic walls (42) and half will flow through channels with non-catalytic walls (46). Fuel combustion will occur at the catalytic surface and heat will be dissipated to the gas flowing in both the catalytic and non-catalytic channels. If the gas from zone (1) is 500° C. and the fuel/air ratio corresponds to a theoretical adiabatic combustion temperature of 1300° C., then combustion of the fuel in the catalytic channels will cause the temperature of all of the flowing gases to rise. The heat is dissipated into gas flowing in both the catalytic and non-catalytic channels. The calculated L-IHE wall temperature is:

$$T_{wall} = \frac{500^\circ\ C. + 1300^\circ\ C.}{2} = 900^\circ\ C.$$

The calculated maximum gas temperature is:

$$T_{gas\ max} = 500^\circ\ C. + [1300^\circ\ C. - 500^\circ\ C.]0.5 = 900^\circ\ C.$$

However, the palladium at one atm of air pressure will limit the wall temperature to 750° C. to 800° C. and the maximum outlet gas temperature will be about <800° C. As can be seen in this case, the palladium limiting is controlling the maximum outlet gas temperature and limiting the wall temperature.

The situation is different at ten atmospheres of air pressure. The palladium limiting temperature is about 930° C. The wall will be limited to 900° C. by the L-IHE structure. In this case, the L-IHE structure is limiting the wall and gas temperature.

The catalyst structure in this zone should have the same approximate catalyst loading, on those surfaces having catalysts, as does the first zone structure. It should be sized to maintain flow in the same average linear velocity as that first zone and to reach a bulk outlet temperature of no more than 800° C., preferably in the range of 600° C. to and most preferably between 700° C. and 800° C. The catalyst can incorporate a non-catalytic diffusion barrier layer such as that described for the first catalytic zone.

Third Catalytic Zone

The third zone in the process takes the partially oxidized gas from the second zone and causes further controlled combustion to take place in the presence of a catalyst structure having integral heat exchange capabilities and, desirably, comprising platinum as the catalytic material. Other combustion catalysts such as palladium, rhodium, osmium, iridium, and the like, may be used in place of or in addition to platinum. Platinum is desireable because of its apparent reactive stability at the higher temperatures. The zone may be essentially adiabatic in operation and, by catalytic combustion of at least a portion of the fuel, further raises the gas temperature to a point where homogeneous combustion may take place or where the gas may be directly used in a furnace or turbine.

The catalyst structure in this zone may be the same as used in the second zone. Desirably, the catalyst used in this zone comprises platinum. Platinum does not show temperature limiting behavior as does palladium; the catalyst substrate can rise to temperatures above 800° C. if no precautions are taken. If the L-IHE catalyst structure of FIG. 3B has 50% of the gas flow through catalytic channels (42) in and 50% through non-catalytic channels (46) and if combustion is complete in the catalytic channels, then the outlet gas temperature of the third zone will be the average of the inlet temperature and the adiabatic combustion temperature as described earlier. The wall temperature and gas temperature will be limited to equations (1) and (2) given earlier. Incomplete reaction in the catalytic channels will result in a lower outlet gas temperature.

If the exhaust gas from the second zone is at a temperature of about 800° C. or more and the fuel/air mixture has a theoretical adiabatic combustion temperature of 1300° C. and 50% of the gas mixture is completely combusted in the catalytic channels, then the outlet temperature from the third zone will be 1050° C. (i.e., the average 800° C. and 1300° C.). This exit gas temperature will result in rapid homogeneous combustion.

The structure of the third zone may take many forms and the catalyst can be applied in a variety of ways to achieve at least partial combustion of the fuel entering the third zone. As an example, use of the structures described above with regard to FIG. 5A and 5B would result respectively in the conversion of 80% or 20% of the gas mixture entering the third zone. The outlet gas temperature from the third zone may be adjusted by catalyst support design.

As a design matter, therefore, the third zone should be designed such that the bulk temperature of the gas exiting the third zone is above its autoignition temperature (if the fourth zone homogeneous combustion zone is desired). The support and catalyst temperature are maintained at the moderate temperature mandated by the relative sizing of the catalytic and non-catalytic channels, the inlet temperature, the theoretical adiabatic combustion temperature, and the length of the third zone. The linear velocity of the gas in the third catalytic zone is in the same range as those of the first and second zones although clearly higher because of the higher temperature.

Homogeneous Combustion Zone

The gas which has exited the three combustion zones may be in a condition suitable for subsequent use if the temperature is correct; the gas contains substantially no $NO_x$ and yet the catalyst and catalyst supports have been maintained at a temperature which permits their long term stability. However, for many uses, a higher temperature is required. For instances, many gas turbines are designed for an inlet temperature of about 1260° C. Consequently, a fourth or homogeneous combustion zone may be an appropriate addition.

The homogeneous combustion zone need not be large. The gas residence time in the zone normally should not be more than about eleven or twelve milliseconds to achieve substantially complete combustion (i.e., <ten ppm carbon monoxide) and to achieve the adiabatic combustion temperature.

The Table below shows calculated residence times both for achievement of various adiabatic combustion temperatures (as a function of fuel/air ratio) as well as achievement of combustion to near completion variously as a function of fuel-(methane)/air ratio, temperature of the bulk gas leaving the third catalyst zone, and pressure. These reaction times were calculated using a homogeneous combustion model and kinetic rate constants described by Kee et al. (Sandia National Laboratory Report No. SAND 80-8003).

TABLE

Calculated Homogenous Combustion Times as a function of inlet temperature, pressure, and F/A (fuel/air) ratio-
Time to $T_{ad}$ and (time to CO < 10 ppm) are in milliseconds>

| | F/A = 0.043 ($T_{ad}$ = 1300° C.) | | F/A = 0.037 ($T_{ad}$ = 1200° C.) | | F/A = 0.032 ($T_{ad}$ = 1100° C.) | |
|---|---|---|---|---|---|---|
| | 1 atm | 10 atm | 1 atm | 10 atm | 1 atm | 10 atm |
| 800° C. | — | 19.7 (21.0) | — | — | — | — |
| 900° C. | — | 3.5 (4.8) | — | 3.3 (6.2) | — | 3.7 (10.2) |
| 1000° C. | 6.5 (14.5) | 1.0 (2.5) | 5.0 (16.0) | 1.0 (3.9) | — | 1.0 (8.1) |
| 1050° C. | 3.6 (11.7) | 0.6 (2.1) | 3.5 (13.5) | 0.6 (3.6) | — | 0.5 (7.7) |
| 1100° C. | 2.5 (10.3) | — | — | — | — | — |

Clearly, for a process used in support of a gas turbine, (e.g., third stage catalyst gas bulk exit temperature=900° C., F/A ratio of 0.043, pressure= ten atm of air), the residence time to reach the adiabatic combustion temperature and complete combustion is less than five milliseconds. A bulk linear gas velocity of less than 40 m/second (as discussed earlier in regard to the catalytic stages) would result in a homogeneous combustion zone of less than 0.2 m in length.

In summary, the process uses three carefully crafted catalyst structures and catalytic methods to produce a working gas which contains substantially no $NO_x$ and is at a temperature comparable to normal combustion processes. Yet, the catalysts and their supports are not exposed to deleteriously high temperatures which would harm those catalysts or supports or shorten their useful life.

EXAMPLES

EXAMPLE 1

This example shows the assembly of a three stage catalyst system.

Stage 1

The first stage was prepared as follows:

A 3% palladium/$ZrO_2$ sol was prepared. A sample of 145 g of $ZrO_2$ powder with a surface area of 45 $m^2$/gm was impregnated with 45 ml of a palladium solution prepared by dissolving $Pd(HN_3)_2(NO_2)_2$ in $HNO_3$ containing 0.83 g palladium/ml. This solid was dried, calcined in air at 500° C., and loaded into a polymer lined ball mill with 230 ml $H_2O$, 2.0 ml concentrated $HNO_3$, and cylindrical zirconia media. The mixture was milled for eight hours.

To 50 cc of this sol (containing about 35% solids by weight) 36 ml of palladium solution was added. The pH was adjusted to about nine and 1.0 ml of hydrazine added. Stirring at room temperature resulted in the reduction of the palladium. The final palladium concentration was 20% palladium/$ZrO_2$ by weight.

A cordierite monolithic ceramic honeycomb structure with 100 square cells per square inch (SCSI) was immersed in the palladium/$ZrO_2$ sol and the excess sol blown from the channels. The monolith was dried and calcined at 850° C. The monolith contained 6.1% $ZrO_2$ and 1.5% palladium. This monolith was again dipped in the same palladium/$ZrO_2$ sol but only to a depth of ten mm, removed, blown out, dried, and calcined. The final catalyst had 25% $ZrO_2$ and 6.2% palladium on the inlet 10.0 mm portion.

Stage 2

The second stage catalyst was prepared as follows:

A $ZrO_2$ colloidal sol was prepared. About 66 g of zirconium isopropoxide was hydrolyzed with 75 cc water and then mixed with 100 g of $ZrO_2$ powder with a surface area of 100 $m^2$/gm and an additional 56 ml of water. This slurry was ball milled in a polymer lined ball mill using $ZrO_2$ cylindrical media for eight hours. This colloidal sol was diluted to a concentration of 15% $ZrO_2$ by weight with additional water.

An Fe/Cr/Al alloy foil was corrugated in a herringbone pattern and then oxidized at 900° C. in air to form alumina whiskers on the foil surface. The $ZrO_2$ sol was sprayed on the corrugated foil. The coated foil was dried and calcined at 850° C. The final foil contained twelve mg $ZrO_2/cm^2$ foil surface.

Palladium 2-ethylhexanoic acid was dissolved in toluene to a concentration of 0.1 g palladium/ml. This solution was sprayed onto one side only of the $ZrO_2$ coated metal foil and the foil dried and calcined at 850° C. in air. The final foil contained about 0.5 mg palladium/$cm^2$ of foil surface.

The corrugated foil was rolled so that the corrugations did not mesh to form a final metal structure of two inch diameter and two inch length with longitudinal channels running axially through the structure and containing about 150 cells per square inch. The foil had palladium/$ZrO_2$ catalyst on one surface only and each channel consisted of catalytic coated and non-catalyst surfaces such as those shown in FIG. 3A.

Stage 3

The third stage catalyst was prepared as follows:

An alumina sol was prepared. About 125 g of a gamma alumina with a surface area of 180 $m^2$/g, 21 ml of concentrated nitric acid, and 165 ml of water were placed in a half gallon ball mill with cylindrical alumina grinding media and milled for 24 hours. This sol was diluted to a solid concentration of 20%.

An Fe/Cr/Al alloy foil was corrugated to form uniform straight channels in the foil strip. When rolled together with a flat foil strip, the spiral structure formed a honeycomb structure with straight channels. The corrugated strip was first sprayed with a 5% colloidal boehmite sol and then with the alumina sol prepared above. A flat strip of metal foil was sprayed in a similar fashion. Only one surface of each foil was coated in this manner. The foils were then dried and calcined at 1100° C.

$Pt(NH_3)_2(NO_2)_2$ was dissolved in nitric acid to produce a solution with 0.13 g platinum/ml. This solution was sprayed onto the coated foil, the foil treated with gaseous $H_2S$, dried, and calcined at 1100° C. The "thickness" of the alumina coating on the metal foil was about four mg/$cm^2$ of flat foil surface. The platinum loading was about 20% of the alumina.

Three Stage Catalyst System

Figure 6:
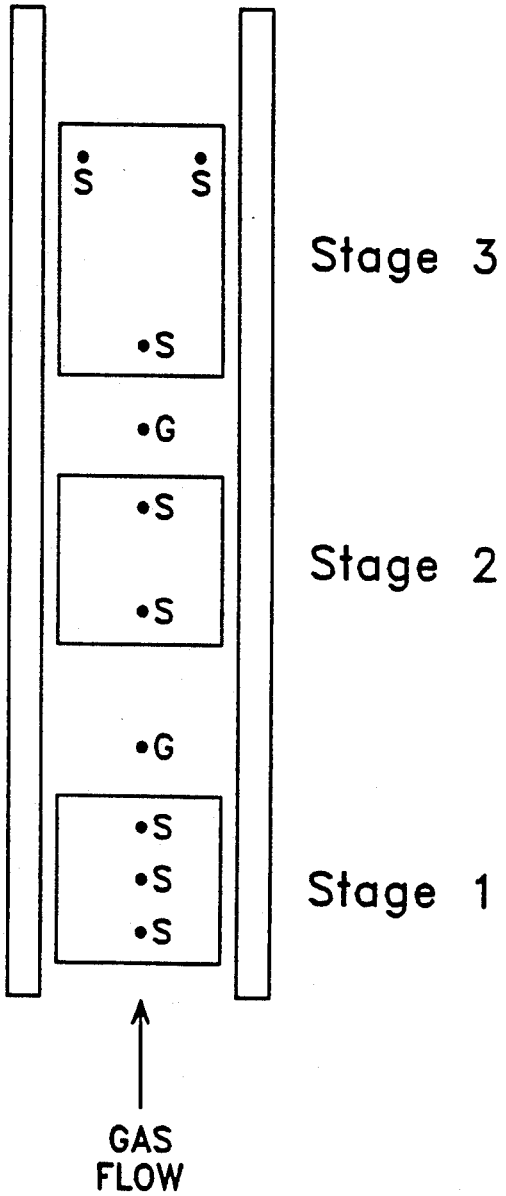
FIG. 6 is a schematic representation of the three stage catalyst test reactor used in the examples.
Figure 7:
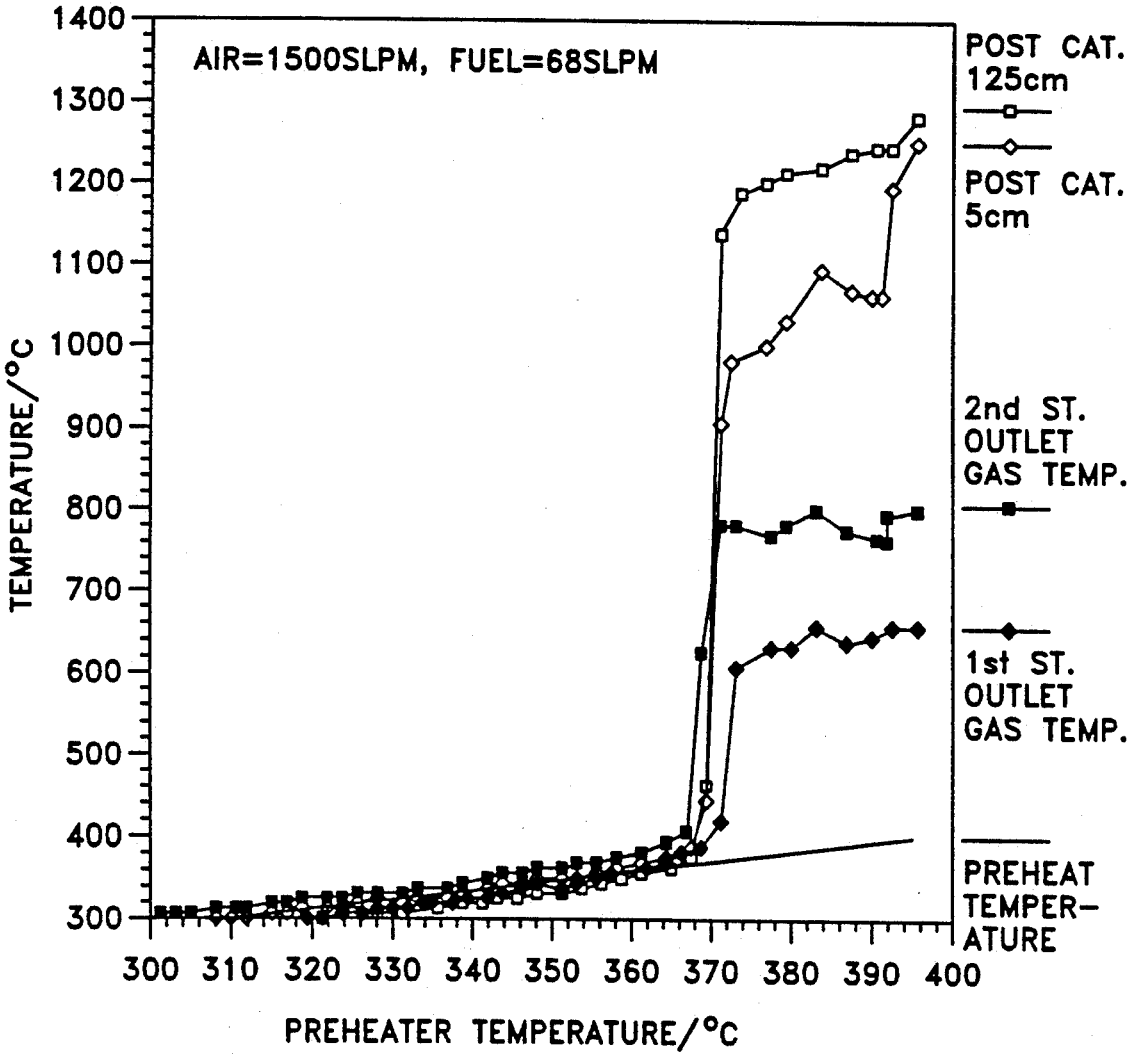
FIGS. 7 and 8 are graphs of various operating temperatures as a function of preheat temperature.
Figure 8:
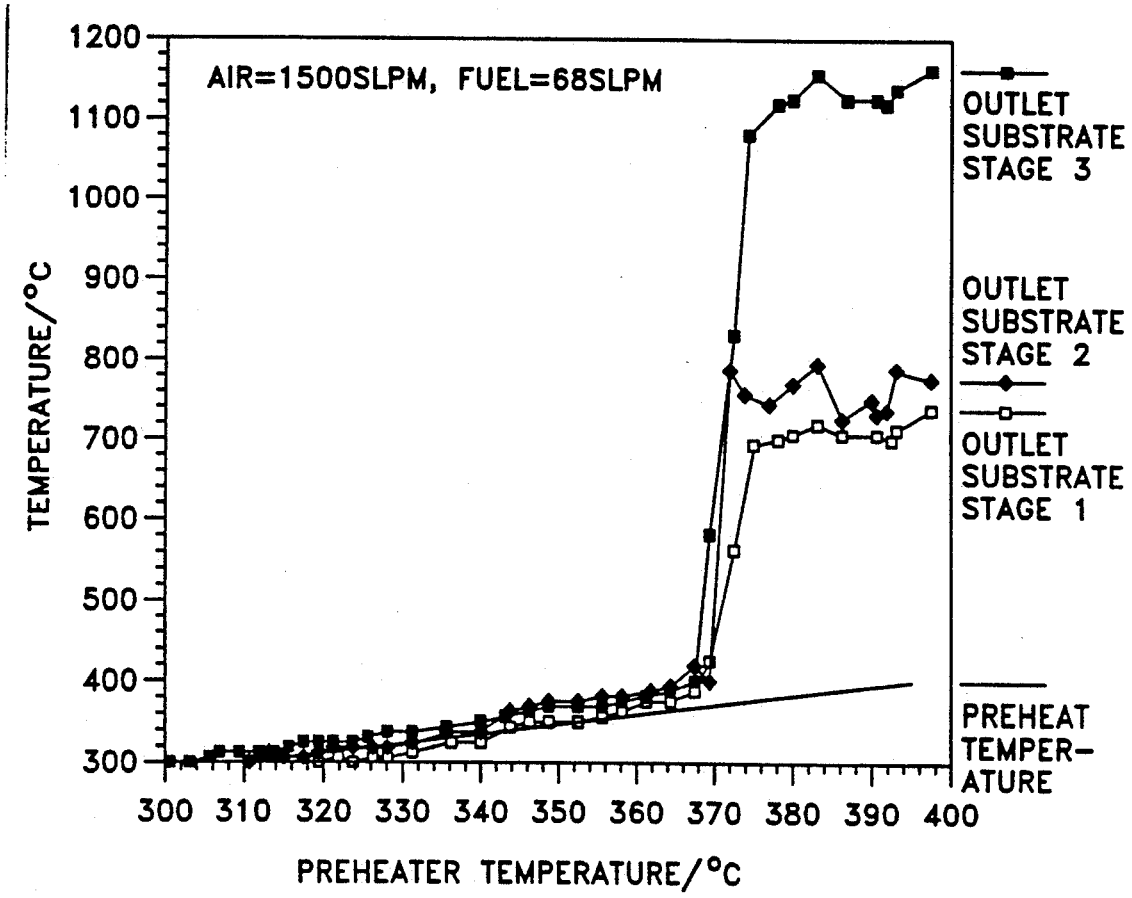

The three catalysts described above were arranged inside a ceramic cylinder as shown in FIG. 6. Thermocouples were located in this system at the positions shown. The thermocouples located in the catalyst sections were sealed inside a channel with ceramic cement to measure the temperature of the catalyst substrate. The gas thermocouples were suspended in the gas stream. The insulated catalyst section of FIG. 6 was installed in a reactor with a gas flow path of 50 mm diameter. Air at 150 SLPM was passed through an electric heater, a static gas mixer, and through the catalyst system. Natural gas at 67 SLPM was added just upstream of the static mixer. The air temperature was slowly increased by increasing power to the electric heater. At 368° C., exit the gas temperatures from stages 1, 2, and 3 began to rise as shown in FIG. 7. Above a preheat temperature of 380° C., the gas temperature from stage 1 was constant at about 530° C., the gas exiting stage 2 was about 780° C., and the gas exiting stage 3 at approximately 1020° C. Homogeneous combustion occurred after the catalyst giving a gas temperature of about 1250° C.; a temperature near the adiabatic combustion temperature of this fuel/air ratio. The substrate temperatures for the three stages are shown in FIG. 8.

As was described above, the stage 1 catalyst lit off at a low temperature and substrate temperature self-limited at about 750° C. This catalyst cell density and gas flow rate produced an intermediate gas temperature of 540° C. Similarly, stage 2 also self-limited the substrate temperature to 780° C. and produced a gas temperature of 750° C. Stage 3 limited the wall temperature at 1100° C.

Figure 9:
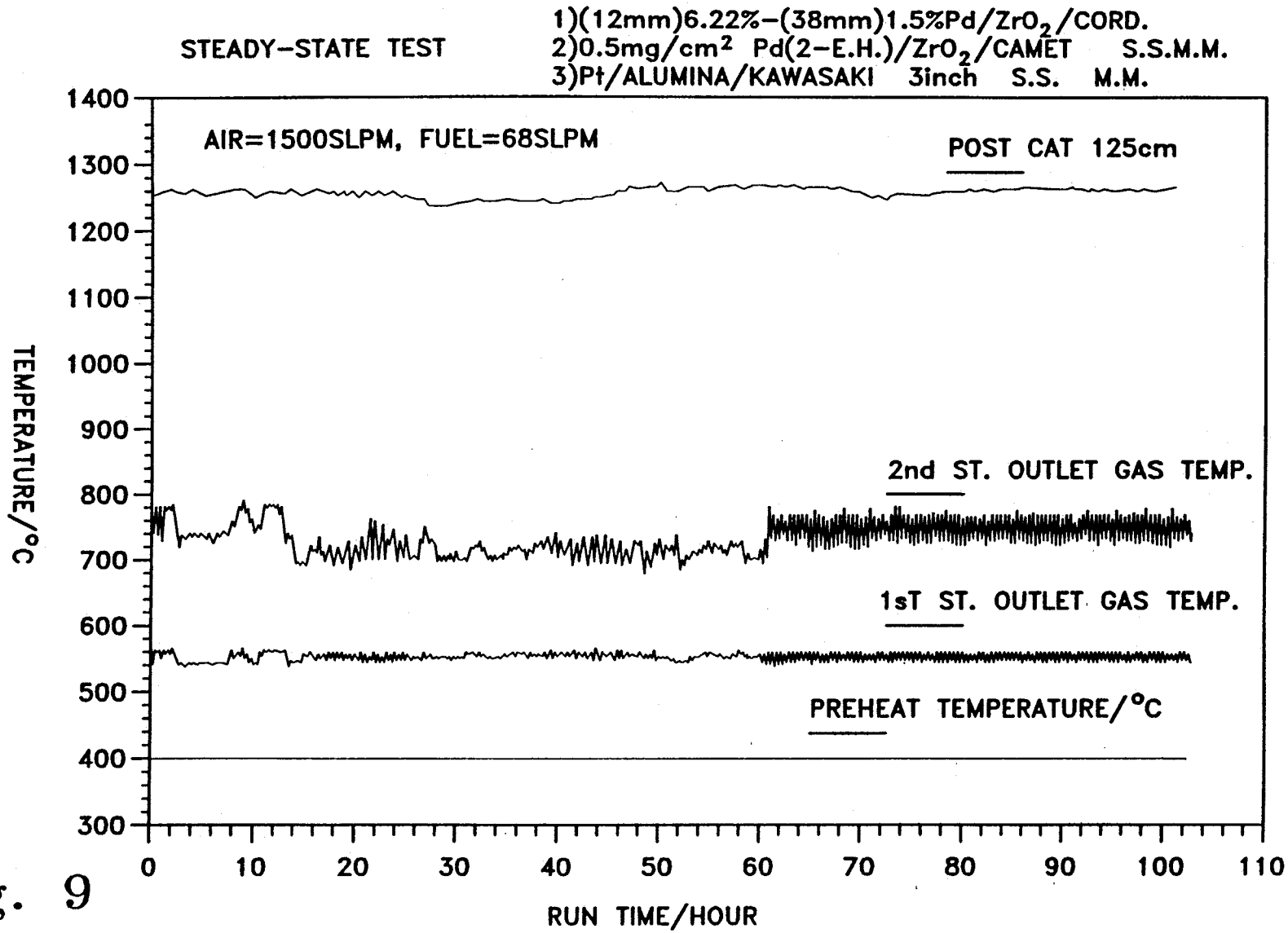
FIG. 9 is a graph of various operating temperatures during a long term steady state operation test.

Limiting the substrate temperature to 750° C. to 780° C. for stages 1 and 2 provided excellent long term catalyst stability. This stability was demonstrated for 100 hours as shown in FIG. 9.

Figure 10:
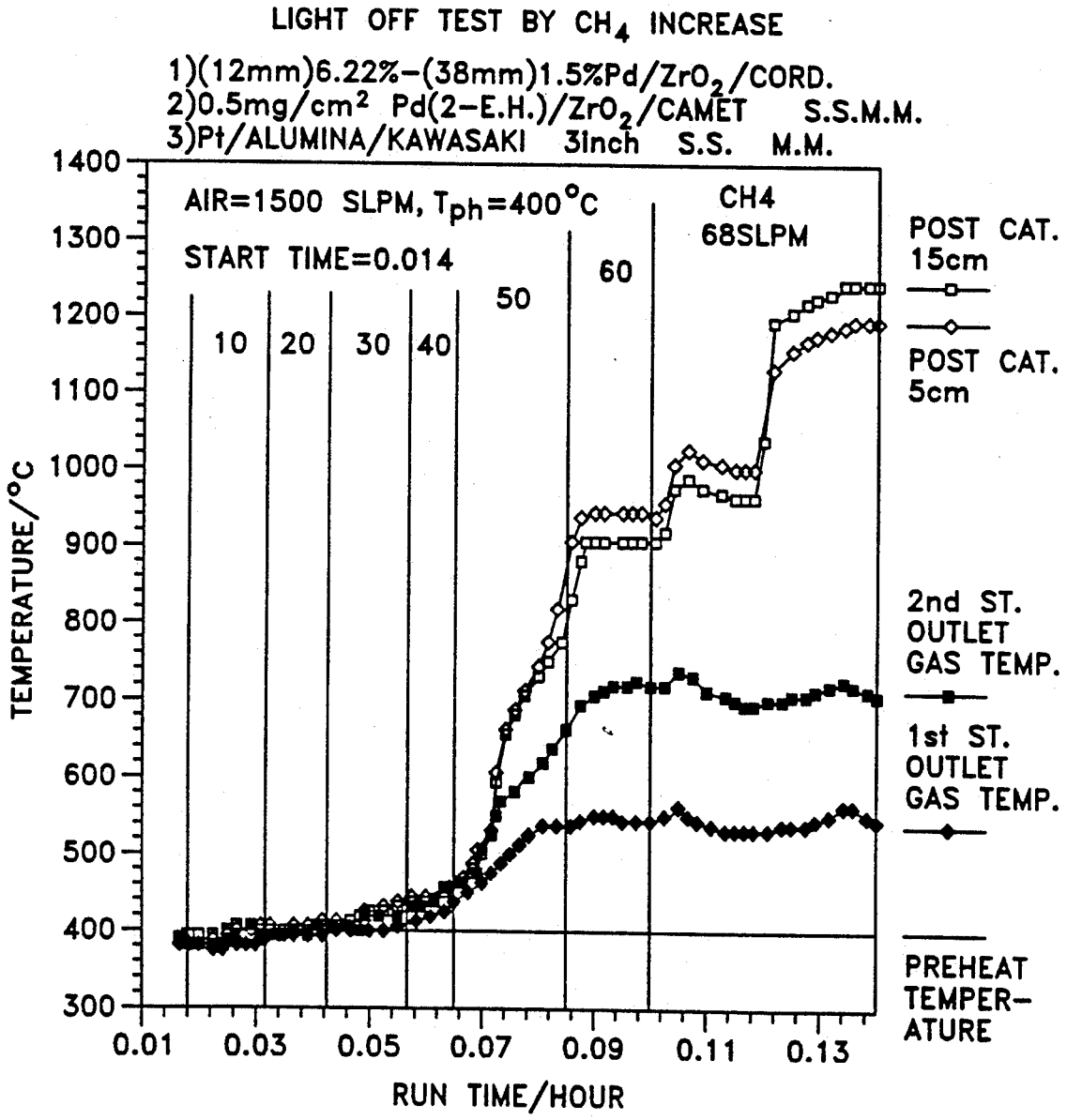
FIG. 10 is a graph of various operating temperatures during a typical start up procedure.

This catalyst system was again ignited by holding the inlet air temperature at 400° C. and increasing the fuel/air ratio by increasing the methane flow rate. This start-up procedure is shown in FIG. 10. Stage 1 achieved an outlet gas temperature of 540° C. at fuel/air=0.033 and maintained this temperature at fuel/air ratios up to 0.045. Complete homogeneous combustion in the region after the catalyst was achieved at a fuel/air ratio of 0.045.

This invention has been shown both by direct description and by example. The examples are not intended to limit the invention as later claimed in any way; they are only examples. Additionally, one having ordinary skill in this art would be able to recognize equivalent ways to practice the invention described in these claims. Those equivalents are considered to be within the spirit of the claimed invention.

We claim as our invention:

1. A process for combusting fuel mixtures comprising the steps of:

a. mixing an oxygen-containing gas with a fuel to form a combustible mixture, b. contacting the combustible mixture in a first zone with a first zone combustion catalyst comprising palladium at reaction conditions sufficient to combust at least a portion but not all of the fuel and produce a first zone combustion catalyst temperature no greater than about 940° C., c. contacting the partially combusted gas from the first zone in a second zone with a second combustion catalyst comprising palladium on a support having integral heat exchange surfaces in which a surface supporting said second zone combustion catalyst is in heat exchange relationship with a surface not supporting a catalyst and both surfaces are in contact with the partially combusted gas at reaction conditions sufficient to combust at least a further portion but not all of the fuel and produce a second zone combustion catalyst temperature of no greater than about 940° C., and contacting the partially combusted gas from the second zone in a third zone with a third zone combustion catalyst comprising platinum on a support having integral heat exchange in which a surface supporting said third zone catalyst is in heat exchange relationship with a surface not supporting a catalyst and both such surfaces are in contact with partially combusted gas at reaction conditions sufficient to combust at least a further portion of the fuel and produce a third zone combustion catalyst temperature no greater than about 1050° C.

2. The process of claim 1 where the combustible mixture is introduced into the first zone at a temperature of at least about 325° C.

3. The process of claim 2 where the combustible mixture is introduced into the first zone at a temperature between 325° C. and 372° C.

4. The process of claim 1 where the bulk temperature of the gas leaving the first zone is between about 500° C. and 650° C.

5. The process of claim 4 where the first zone combustion catalyst comprises palladium on a metallic support.

6. The process of claim 1 where the first zone combustion catalyst additionally contains one or more Group IB metals or Group VIII metals.

7. The process of claim 6 where the first zone combustion catalyst additionally contains silver or platinum.

8. The process of claim 1 where the first zone combustion catalyst comprises a support having integral heat exchange surfaces.

9. The process of claim 1 where the bulk temperature of the gas leaving the second zone is between about 750° C. and 800° C.

10. The process of claim 1 where the second zone combustion catalyst additionally contains one or more Group IB metals or Group VIII metals.

11. The process of claim 10 where the second zone combustion catalyst additionally contains silver or platinum.

12. The process of claim 1 where the bulk temperature of the gas leaving the third zone is between about 850° C. and 1050° C.

13. The process of claim 12 where the bulk temperature of the gas leaving the third zone is between about 850° C. and 1050° C.

14. The process of claim 1 where the oxygen-containing gas is air and is compressed to a pressure of 0.0 to 35 atms (gauge).

15. The process of claim 1 where the first zone combustion catalyst comprising palladium on a metallic support additionally comprises a barrier layer covering at least a portion of the palladium containing catalyst.

16. The process of claim 15 where the barrier layer comprises aluminum oxide.

17. The process of claim 1 additionally comprising the step of oxidizing any remaining unoxidized fuel in a fourth zone to produce a gas having a temperature greater than that of the gas leaving the third zone but no greater than about 1700° C.

18. A process for combusting fuel mixtures to produce a low $NO_x$ gas comprising the steps of:

a. contacting a combustible mixture of a fuel and air in a first zone with a first zone combustion catalyst comprising palladium on a support at reaction conditions sufficient to combust at least a portion but not all of the fuel and produce a partially combusted gas both at a bulk and localized temperature no greater than about 800° C., b. contacting the partially combusted gas from the first zone in a second zone with a second zone combustion catalyst comprising palladium on a support having integral heat exchange surfaces in which a surface supporting said second zone combustion catalyst is in heat exchange relationship with a surface not supporting a catalyst and both surfaces are in contact with the partially combusted gas at reaction conditions sufficient to combust at least a portion but not all of the fuel and produce a partially combusted gas at a bulk temperature greater than the bulk temperature of the gas leaving the first zone but not greater than about 900° C., and c. contacting the partially combusted gas from the second zone in a third zone with a third zone combustion catalyst comprising platinum on a support having integral heat exchange surfaces in which a surface supporting said third zone combustion catalyst is in heat exchange relationship with a surface not supporting a catalyst and both surfaces are in contact with the partially combusted gas at reaction conditions sufficient to combust at least a portion of the fuel and produce a low $NO_x$ gas both at a bulk and localized temperature greater than the bulk temperature of the gas leaving the second stage but less than about 1200° C.

19. The process of claim 18 wherein the combustible mixture is introduced into the first zone at a temperature of at least about 325° C.

20. The process of claim 19 where the combustible mixture is introduced into the first zone at a temperature between 325° C. and 375° C.

21. The process of claim 18 where the bulk temperature of the gas leaving the first zone is no greater than about 550° C.

22. The process of claim 21 where the bulk temperature of the gas leaving the first zone is between about 500° C and 600° C.

23. The process of claim 18 where the first zone combustion catalyst support is ceramic or metal.

24. The process of claim 23 where the first zone combustion catalyst support is metal.

25. The process of claim 18 wherein the bulk temperature of the gas leaving the second zone is between about 700° C. and 800° C.

26. The process of claim 18 where the second zone combustion catalyst support is metal or ceramic.

27. The process of claim 26 where the second zone combustion catalyst support is metal.

28. The process of claim 18 where the bulk temperature of the gas leaving the third zone is between about 850° C. and 1150° C.

29. The process of claim 25 where the bulk temperature of the gas leaving the third zone is between about 850° C. and 1150° C.

30. The process of claim 18 where the third stage combustion catalyst support is ceramic or metal.

31. The process of claim 30 where the third stage combustion catalyst support is metal.

32. The process of claim 18 where the first zone combustion catalyst comprising palladium on a metallic support additionally comprises an oxide barrier layer covering at least a portion of the palladium.

33. The process of claim 32 where the barrier comprises zirconia.

34. The process of claim 18 additionally comprising of the step of oxidizing any remaining unoxidized fluid level in a fourth zone to produce a gas having a temperature greater than that of the gas leaving the third zone but no greater than about 1700° C.

35. The process of claim 29 additionally comprising the step of oxidizing any remaining unoxidized fluid level in a fourth zone to produce a gas having a temperature greater than that of the gas leaving the third zone but no greater than about 1700° C.

36. A process for combusting fuel mixtures to produce a low $NO_x$ gas comprising the steps of:

a. mixing methane and air to product a compressed mixture, b. contacting the compressed mixture in a first zone with a first zone combustion catalyst comprising palladium on a metallic support at reaction conditions sufficient to combust at least a portion but not all of the methane and produce a partially combusted gas at both bulk and localized temperatures no greater than about 800° C., c. contacting the partially combusted gas from the first zone in a second zone with a second zone combustion catalyst comprising palladium on a metallic support having integral heat exchange surfaces in which a surface supporting said second zone combustion catalyst is in heat exchange relationship with a surface not supporting a catalyst and both surfaces are in contact with the partially combusted gas at reaction conditions sufficient to combust at least a portion but not all of the methane and produce a partially combusted gas at a bulk temperature greater than the bulk temperature of the gas leaving the first zone but no greater than about 900° C., and d. contacting the partially combusted gas from the second zone in a third zone with a third zone combustion catalyst comprising platinum on a metallic support having integral heat exchange surfaces in which a surface supporting said third zone combustion catalyst is in heat exchange relationship with a surface not supporting a catalyst and both surfaces are in contact with the partially combusted gas at reaction conditions sufficient to combust at least a portion of the methane and produce a low $NO_x$ gas at a bulk and a localized temperature greater than the bulk temperature of the gas leaving the second zone but no greater than about 1200° C.

37. The process of claim 36 where the gas from the third zone contains uncombusted methane and additionally comprising the steps of combusting the remaining methane in a fourth zone to produce a gas having a bulk temperature greater than that of the gas leaving the third zone but no greater than about 1700° C.

38. The processes of claim 37 where the low $NO_x$ gas has no more than about five ppm $NO_x$.

* * * * *